US005232350A

United States Patent [19]

Richardson

[11] Patent Number: 5,232,350

[45] Date of Patent: Aug. 3, 1993

[54] MOTOR DRIVEN PUMP ASSEMBLY WITH A PROTECTIVE COVER

[75] Inventor: Curtis G. Richardson, Energy, Ill.

[73] Assignee: Maytag Corporation, Newton, Iowa

[21] Appl. No.: 713,089

[22] Filed: Jun. 11, 1991

[51] Int. Cl.[5] ..... F04B 39/14

[52] U.S. Cl. ..... 417/360; 417/423.11; 417/424.2

[58] Field of Search ..... 417/360, 423.11, 423.14, 417/423.15, 423.9, 424.1, 424.2; 415/168.1, 168.2, 213.1

[56] References Cited

U.S. PATENT DOCUMENTS

| | | | |
|---|---|---|---|
| 1,347,732 | 7/1920 | Cooper | 415/168.2 |
| 2,844,100 | 7/1954 | Heinicke | 417/423.14 |
| 2,978,988 | 4/1961 | McAlpine | 417/423.14 |
| 2,993,449 | 7/1961 | Harland | 417/423.14 |
| 3,170,621 | 2/1965 | Morrison | 417/423.15 |
| 3,179,058 | 4/1965 | Meagher | 417/360 |
| 3,186,345 | 6/1965 | Ivanoff | 415/168.2 |
| 3,199,745 | 8/1965 | Hollis | 417/360 |
| 3,358,608 | 12/1967 | Chabica | 415/174.3 |
| 3,526,469 | 9/1970 | Lipe | 417/423.11 |
| 3,536,412 | 10/1970 | Beare et al. | 415/129.2 |
| 3,549,277 | 12/1970 | Kiss | 415/168.2 |
| 3,594,102 | 7/1971 | Oden | 417/423.11 |
| 3,664,760 | 4/1972 | Reiner | 415/174.2 |
| 3,680,976 | 8/1972 | Buse | 415/168.2 |
| 3,702,745 | 11/1972 | Segebrecht | 417/68 |
| 3,961,758 | 6/1976 | Morgan | 417/424.1 |
| 4,306,841 | 12/1981 | Morrison et al. | 417/360 |
| 4,669,956 | 6/1987 | Brunel | 417/423.14 |
| 4,810.174 | 3/1989 | Stuckey | 417/423.14 |
| 4,850,818 | 7/1989 | Kotera | 417/423.14 |
| 4,880,364 | 11/1989 | Berfield | 417/360 |
| 4,884,946 | 12/1989 | Belanger | 417/360 |
| 4,904,166 | 2/1990 | Wasemann | 417/360 |
| 4,978,281 | 12/1990 | Conger | 417/423.14 |
| 4,997,342 | 3/1991 | Conger | 417/423.15 |

*Primary Examiner*—Richard A. Bertsch
*Assistant Examiner*—Peter Korytnyk
*Attorney, Agent, or Firm*—Bacon & Thomas

[57] ABSTRACT

A motor mounted pump assembly for use with an agitator-type clothes washing machine is disclosed which includes a pump, having an impeller located in a pump housing, mounted to a motor casing such that a drive shaft from the motor extends into the pump housing and drivingly engages the impeller. Interposed between the pump and motor is a cover member which is fixedly secured to the pump housing and which is intended to divert any leakage from the pump housing from coming into contact with the motor or any associated electrical components of the washing machine. By fixedly securing the cover member to the pump housing, the pump and cover member may be removed from the motor as a unitary piece in the event the pump needs to be replaced or repaired. Furthermore, at the connection points between the cover member and the pump housing, the cover member is formed with embossed areas which function to divert any fluid leaking from the pump housing away from these areas. Additional openings are provided in the cover member to permit mounting legs, formed integral with the pump housing, to be directly secured to the motor casing. These openings are surrounded by upstanding ridges which also function to divert any fluid leakage away from these openings.

30 Claims, 4 Drawing Sheets

MOTOR DRIVEN PUMP ASSEMBLY WITH A PROTECTIVE COVER

BACKGROUND OF THE INVENTION

The present invention relates to a motor mounted pump assembly particularly adapted for use with an agitator-type clothes washing machine. More particularly, the invention pertains to a motor mounted pump assembly including a pump, a motor and a cover member interposed therebetween which protects the motor in the event of fluid leakage from the pump.

It is known int he art to fixedly secure a pump housing to a motor with a cover plate therebetween as represented by U.S. Pat. No. 2,844,100. In this arrangement, however, the cover plate actually aides in defining the fluid chamber in which the pump impeller is located and does not function to divert any fluid leaking downward from the pump away from the motor.

U.S. Pat. No. 4,904,166 discloses a motor-pump assembly for use with clothes washing machines wherein a dish-like drip shield is located between an end bell of a motor and a pump housing and functions to divert water away from the underlying motor should any water leak downward from the pump. In this arrangement, the shield includes numerous downwardly extending leg portions having ends which are located in recesses formed in a top end bell of the motor. Each leg portion also extends above the drip shield and includes upper locating recesses which receive downwardly extending leg portions formed integral with the pump housing. Numerous spring clips then extend between the motor and the pump housing in order to secure the motor, the shield and the pump together.

Neither of the arrangements in the above discussed prior art patents fixedly secured the cover plate or drip shield directly to the pump housing such that the pump housing and cover member can be disassembled from the motor as a unitary piece. When leakage does occur from the pump housing, which is most often due to problems associated with seals mounted in the pump housing, the pump must be disassembled form the motor and either be replaced or repaired. Obviously, as the pump is being disconnected from the motor it can continue to leak. Therefore, in order to fully protect the motor and associated electrical components from such leakage, it is highly advantageous to remove the pump and cover member from the motor as a unitary piece such that the cover member can continue to function to prevent leakage from coming into contact with the motor until the unitary assembly is moved away from the motor and the electrical components of the clothes washer.

Furthermore, in the prior art as represented by U.S. Pat. No. 4,904,166 discussed above, operating forces developed by the pump are transmitted through the drip shield to the motor. This is undesirable since it requires additional manufacturing tolerances and a shield construction that can withstand these forces which leads to high production costs.

It is the purpose of the present invention to provide a motor mounted pump assembly having a water collecting cover member interposed between a pump housing and a motor casing wherein the cover member is fixedly secured to the pump housing and then this unitary piece is separately secured to the motor. Such a motor mounted pump assembly facilitates safe removal of the pump from the motor and washing machine. In addition, the pump housing is directly secured to the motor such that the cover member need not transmit operating forces from the pump to the motor. This direct connection also eliminates one set of manufacturing tolerances.

SUMMARY OF THE INVENTION

The motor mounted pump assembly in accordance with the present invention includes a pump having a housing and an impeller located within the housing, a motor comprising a casing which rotatably supports a drive shaft protruding out of the casing and a cover member.

The cover member is fixedly secured to the pump housing such that substantially centrally located apertures in the cover member and pump housing are aligned with a central drive sleeve formed integral with the impeller. As a unitary piece, the cover member and pump housing can then be fixedly secured to the motor casing such that the drive shaft of the motor can extend through the centrally located apertures and drivingly engage the impeller.

Also in accordance with the invention, the cover member is formed with a trough portion adapted to collect any water leakage from the pump. Furthermore, in order to prevent any leakage at either the substantially centrally located aperture in the cover member or the interconnection locations of the cover member to the pump housing, the cover member is formed with either embossed areas or upstanding ridges which function to divert water away from these areas and to the trough portion.

Other objects, features and advantages of the invention shall become apparent from the following detailed description of the preferred embodiment thereof, when taken in conjunction with the drawings wherein like reference characters refer to corresponding parts in the several views depicted.

DETAILED DESCRIPTION OF THE PREFERRED EMBODIMENT

Figure 1:
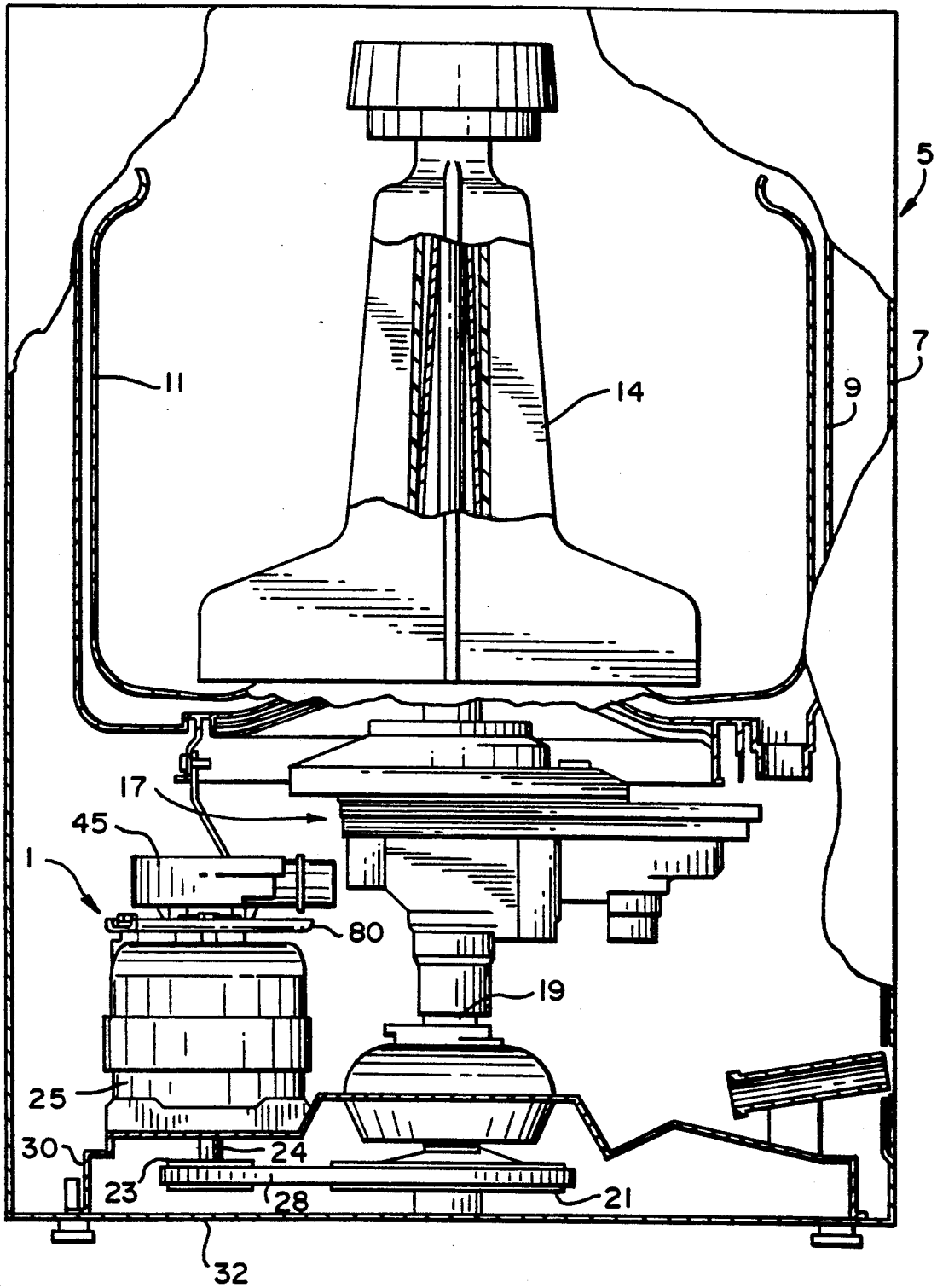
FIG. 1 is a cross-sectional view of an agitator type washing machine embodying the motor mounted pump assembly of the present invention.

FIG. 1 depicts a cross-sectional view showing the motor mounted pump assembly 1 of the present invention mounted within an agitating clothes washer generally indicated at 5. In general, the clothes washer 5 includes a washer housing 7 in which is located an outer fluid retaining tub 9, an inner tub 11 and an agitator 14. As is well-known in the art, outer tub 9 holds wash and rinse water to be used in washing clothes which are inserted, generally through a hinged cover (not shown), into inner tube 11. The clothes are washed or rinsed by the oscillating action of agitator 14 and spun dry by rotation of inner tube 11.

The oscillating movement imparted to agitator 14 along with rotary movement of inner tub 11 is transmitted through a transmission mechanism located within a housing generally indicated at 17. As is known in the art, the transmission mechanism comprises various interengaging gear elements which are driven by means of a transmission input shaft 19. Transmission input shaft 19 has fixed, at a lower end thereof, a driven pulley 21. Driven pulley 21 is interconnected with drive pulley 23 mounted to an end of output shaft 24 of motor 25. Driven pulley 21 and drive pulley 23 are interconnected by belt 28. As clearly shown in FIG. 1, the motor mounted assembly 1 of the present invention is mounted upon a support platform 30 fixed to base 32 of washer housing 7. It should be noted that the agitating clothes washing machine arrangement discussed this far is conventional and, since its operation is well-known to those of ordinary skill in the art, a discussion of its structure and operation will be limited to that recited above.

Figure 2:
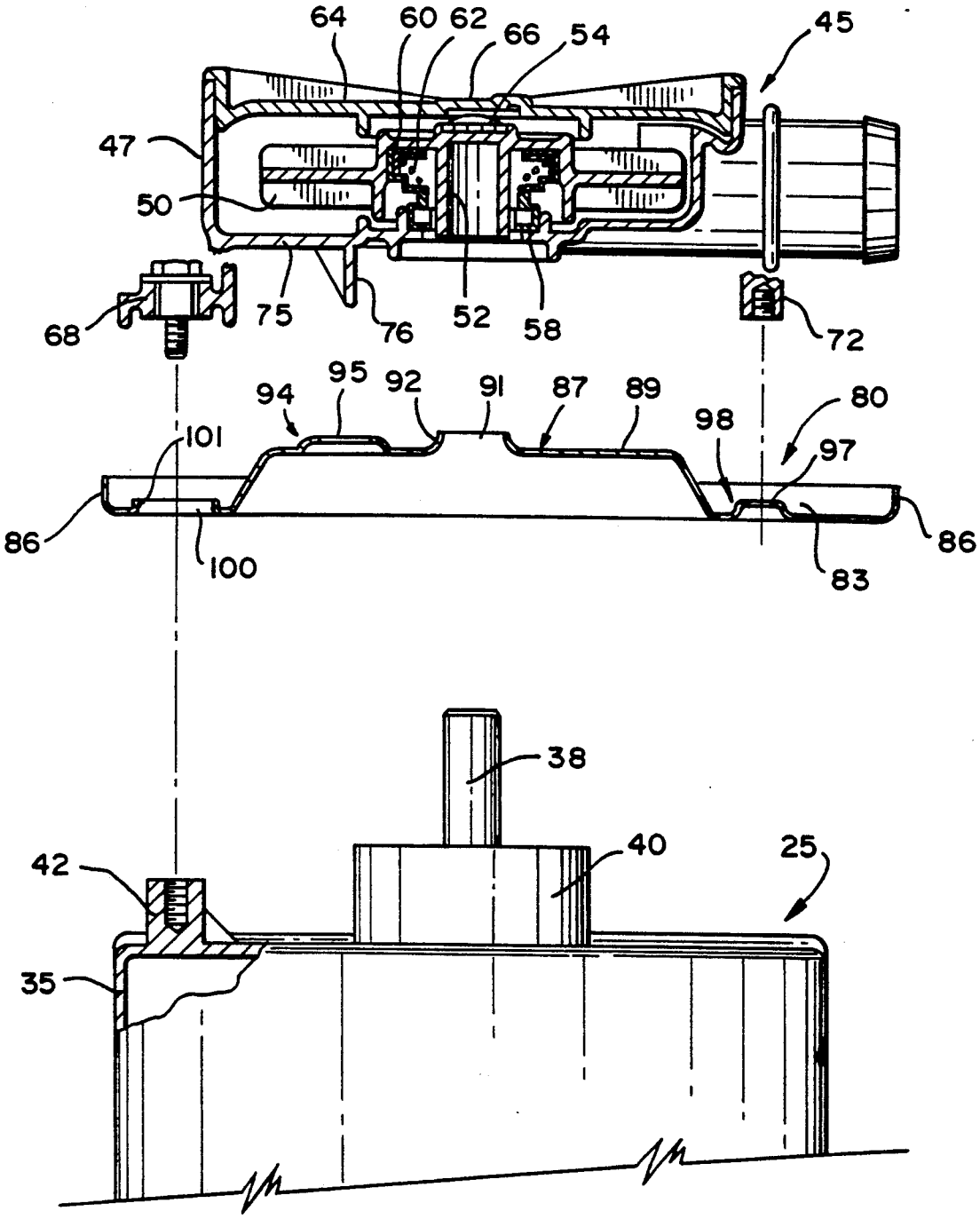
FIG. 2 is an exploded view of the motor mounted pump assembly in accordance with a particular embodiment of the invention.
Figure 3:
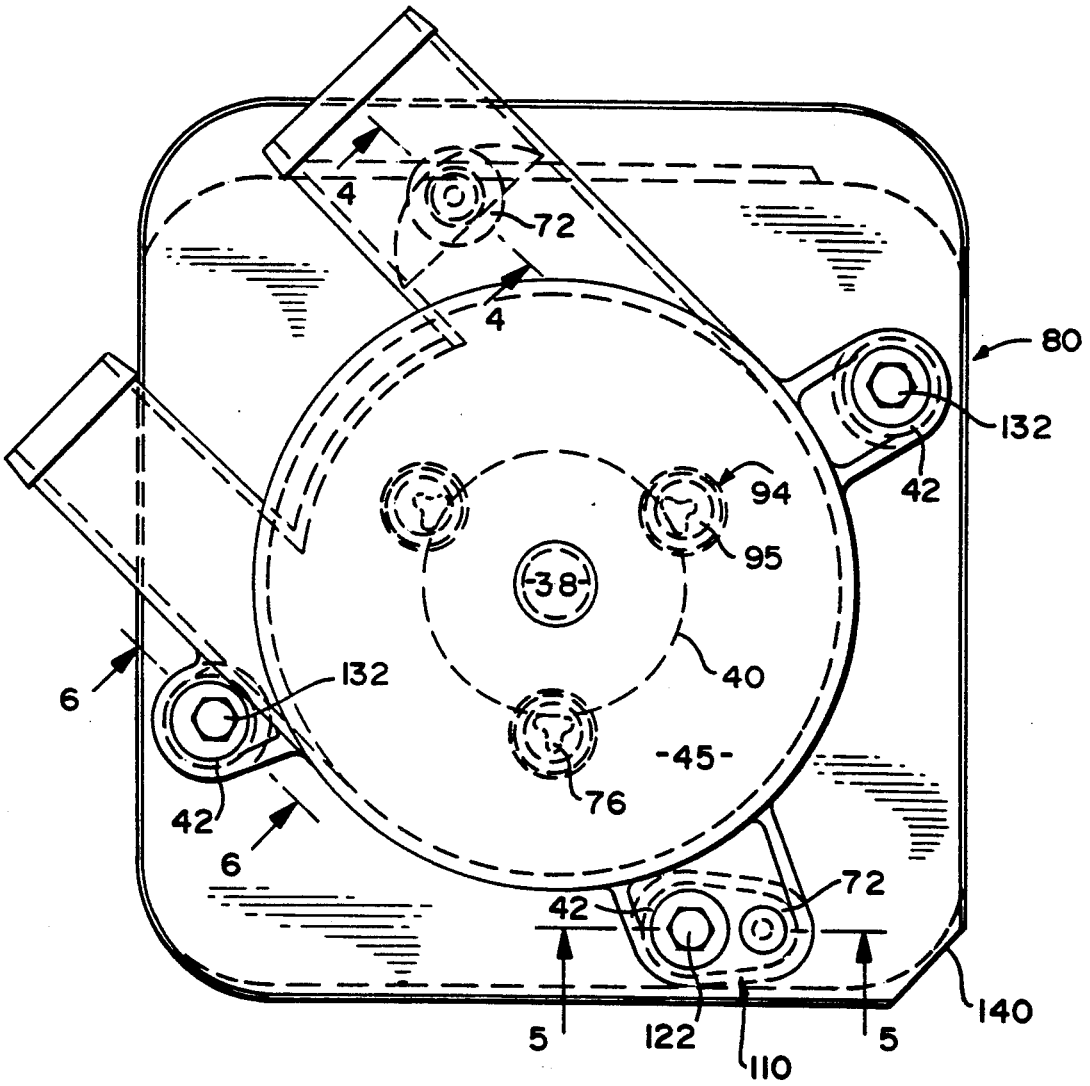
FIG. 3 is a top view of the motor pump assembly of the present invention.

Before discussing the specific interconnections of the components of motor mounted pump assembly 1, each of the individual components will be individually described. FIG. 2 represents an exploded view of motor mounted pump assembly 1 showing motor 25 including a motor casing 35 and a substantially upright drive shaft extension 38. Drive shaft extension 38 is rotatably supported within motor casing 35 by means of bearings (not shown) located within a bearing cover 40. Formed integral with motor casing 35 are a plurality of mounting posts 42. As shown in FIG. 3, three such mounting posts 42 are formed with motor casing 35 and are substantially equally radially and circumferentially spaced with respect to drive shaft extension 38.

With continued reference to FIGS 2 and 3, pump 45 includes a pump housing 47 having an impeller 50 located therein. Impeller 50 includes a central sleeve portion 52 which, although not particularly shown in the drawings, includes at least one flat surface portion, preferably two, on its inner diameter which conforms to flat surface portions on the outer diameter of drive shaft extension 38 such that drive shaft extension 38 may extend into central sleeve portion 52 in order to drive impeller 50 as is known in the art. Impeller 50 includes an upper thrust button 54 which is secured to rotate with impeller 50 by various radial lugs (not shown). Impeller 50 is mounted within pump housing 47 by first and second annular seals 58, 60. In addition, a seal spring 62 biases the impeller upward as shown in FIG. 2. Pump 45 also includes a pump cover 64 which is secured to pump housing 47 by spin welding or the like. A thrust plate 66, which is secured to pump cover 64 by appropriate fasteners (not shown), is adapted to be engaged by thrust button 54 on the impeller in order to oppose the upward force exerted on the impeller 50 by seal spring 62.

As will be explained more fully below with reference to FIGS. 2 and 3, pump housing 47 includes a plurality of mounting legs 68 for use in securing pump housing 47 to mounting post 42 of motor casing 35. In the preferred embodiment, three such mounting legs circumferentially spaced about the perimeter of pump housing 47 and are aligned with mounting posts 42 on motor casing 35. The exact interconnection of pump housing 47 to motor casing 35 will be explained more fully hereinafter.

Pump housing 47 is also formed with a plurality of mounting bosses 72. As shown best in FIG. 3, the preferred embodiment of the invention utilizes two such mounting bosses 72 which are formed integral with the pump housing 47 and are located on opposite sides of central sleeve portion 52. In addition to these mounting bosses 72, extending downward from a lower surface portion 75 of pump housing 47 are a plurality of locating fingers 76. Each of these locating fingers 76 are positioned radially inward with respect to mounting leg 68 and mounting bosses 72 as clearly shown in FIG. 3. The functioning of mounting bosses 72 and locating fingers 76 will be discussed more fully hereinafter.

As represented in FIG. 2, interposed between motor 25 and pump 45 is a cover member 80. In the preferred embodiment, cover member 80 is generally rectangular in shape as depicted in FIG. 3 and includes a fuel diverting trough portion 83 defined between an upstanding outer rim 86 and an upstanding central portion 87. Upstanding central portion 87 includes a sloped wall portion 88 and an upper surface portion 89. Located substantially in the center upper surface portion 89 is an aperture 91 located within an upstanding annular ridge 92. Also located in upstanding central portion 89, circumferentially and radially spaced from aperture 91, are a plurality of embossed areas 94 having locating openings 95 therein. Additional mounting openings 97 are provided in embossed areas 98 of trough portion 83 in order to permit cover member 80 to be fixedly secured to pump housing 47. Furthermore, through portion 83 includes various circumferentially spaced openings 100 defined by an upstanding edge 101 of trough portion 83 to permit direct interconnection of pump housing 47 to motor casing 35 as will be explained herein.

Figure 4:
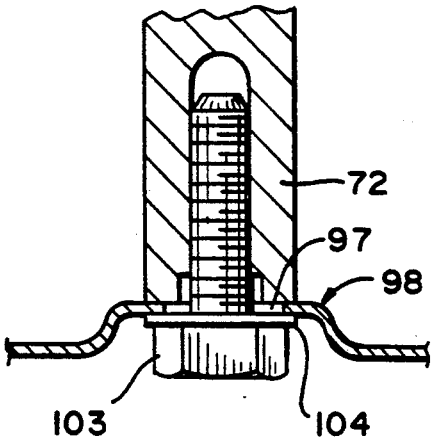
FIG. 4 is a cross-sectional view taken along line 4—4 of FIG. 3.

As previously stated, pump housing 47 is provided with two mounting bosses 72 for fixedly securing cover member 80 to pump housing 47 as shown in FIG. 3. The interconnection of cover member 80 to one of these mounting bosses 72 will now be described with reference to FIG. 4 which depicts a cross-sectional view taken along line 4—4 of FIG. 3. Mounting opening 97 located in an embossed area 98 of trough portion 83 is aligned with one of mounting bosses 72 formed integral with pump housing 47 such that a self-tapping screw 103, having a washer 104, thereon may extend upwardly through mounting opening 97 and be threadably received within mounting boss 72. In this construction, a portion of embossed area 98, adjacent mounting opening 97, is interposed between washer 104 and mounting boss 72 when screw 103 is tightened. Of course, it should be recognized that other mounting arrangements could be utilized. For instance, mounting boss 72 may be internally threaded and a bolt could be used in place of screw 103.

The second connection between cover member 80 and pump housing 47 will now be described with reference to FIG. 5. In this figure, which represents a cross-sectional view taken along line 5—5 of FIG. 3, a combined mounting leg and boss assembly 110 formed integral with pump housing 47 is shown. Similar to embossed area 98, cover member 80 is formed with an embossed area 114 having an opening 116 aligned with an internal bore 73 of mounting boss 72. A self-tapping screw 117, having washer 118 mounted thereon, is then extended upwardly through opening 116 and cover member 80 and is threaded within mounting boss 72 with a portion of cover member 80 being located between washer 118 and mounting boss 72. Therefore, by these two connections just described, it can readily be seen that cover member 80 is fixedly secured to pump housing 47 such that pump 45 and cover member 80 may be manipulated as a unitary piece.

Figure 5:
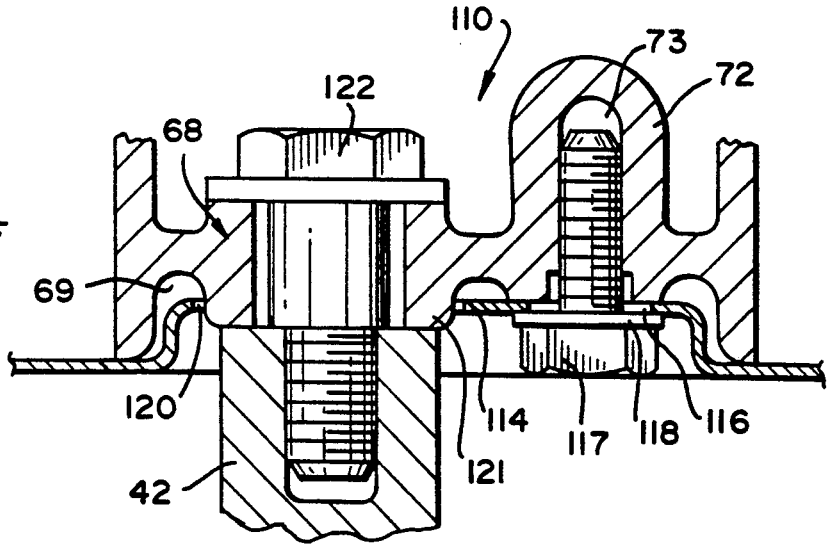
FIG. 5 is a cross-sectional view taken all along line 5—5 of FIG. 3.

As previously stated, FIG. 5 shows a combined mounting leg and boss assembly 110. The boss assembly, as discussed above, is used for securing the cover member 80 to the pump housing 47 while the mounting leg portion of assembly 110 is used for fixedly securing the pump housing 47 to motor casing 35. As also discussed above with reference to FIG. 3, three such mounting legs 68 are used to interconnect pump 45 and motor 25. The mounting leg 68 in the combined mounting leg and boss assembly 110 shown in FIG. 5 represents one of these three connections. As shown in this figure, embossed area 114 not only includes opening 116 for receiving screw 117 but also includes an aperture 120 for receiving a central portion 121 of mounting leg 68. Central portion 121 extends freely through cover member 80 with a predetermined amount of clearance. A should screw 122 extends through central portion 121 of mounting leg 68 and is threadably received within mounting post 42. In order to accommodate the embossed area 114 of cover member 180, mounting leg 68 includes an annular recess 69 into which the upwardly extending embossed portion of cover member 80 may extend.

Figure 6:
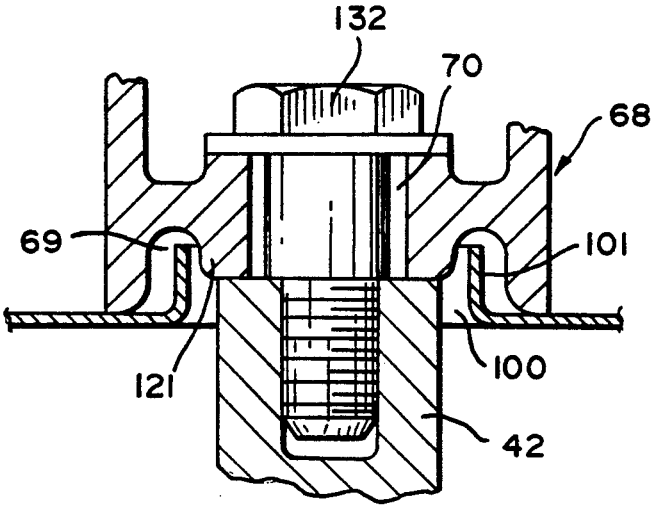
FIG. 6 is a cross-sectional view taken along line 6—6 of FIG. 3.

Reference will now be made to the connection shown in FIG. 6 which depicts the two additional interconnections between the pump housing 47 and the motor casing 35 shown in FIG. 2. As is generic with all of the mounting legs 68, the mounting leg 68 shown in FIG. 6 is located within trough portion 83 of cover member 80 and includes an annular recess 69 a central aperture 70 and a central portion 121 which extends into an opening 100 in cover member 80. Annular, upwardly extending ridge 101 formed about opening 100 extends into annular recess 69 of mounting leg 68. When pump housing 47 is secured to motor casing 35, a flanged screw 132 extends through central aperture 70 of mounting leg 68 and is threadably received within mounting post 42 on motor casing 35. In this connection, mounting leg 68 directly abuts mounting post 42.

The assembly of the motor mounted pump according to the present invention will now be systematically described. First, cover member 80 is fixedly secured to pump housing 47 with locating fingers 76 extending through openings 95 while the two mounting openings 97 and 116 formed in the cover member 80 are aligned with the mounting bosses 72 of pump housing 47. Screws 103 and 117 are then threaded within mounting bosses 72 and thereby fixedly secure cover member 80 to pump housing 47.

Pump housing 47 and cover member 80 can then be lowered upon motor 25 as a unitary piece such that drive shaft extension 38 is received within central sleeve 52 to thereby drivingly engage impeller 50. When pump housing 47 and cover member 80 are placed upon motor 25, locating fingers 76 contact the periphery of bearing cover 40 of motor 25 to provide a concentric fit between motor 25 and pump housing 47 and mounting leg 68 are aligned with mounting posts 42. The shouldered screws 122 and 132 are then placed through the central apertures 70 of mounting legs 68 and are threadably received within mounting posts 42.

When assembled, cover member 80 slopes slightly such that any water which leaks from pump housing 47 will gather in trough portion 83. The water can then be funneled out through an outlet 140 which, in the preferred embodiment, is located in a corner of cover member 80 as shown in FIG. 3. Outlet 140, however, may simply constitute a hole in trough portion 83. Due to the presence of the raised and embossed areas in cover member 80 around each opening and aperture, any leakage from pump housing 47 will be forced to flow around these openings and apertures and not through them. Therefore, cover member 80 will prevent any water from leaking onto motor 25 or its associate electrical wiring or switches. If any leakage is present, the pump housing 47 and the cover member 80 may be removed from the motor casing 35 as a unitary piece in order to maintain the integrity of motor 25 and associated electrical system from any leakage. In addition, by the construction of the motor mounted assembly of the present invention, the direct mounting of the cover member 80 to the pump housing 47 and the pump housing to the motor casing 35 provides a structurally rigid configuration which aides in the proper power transmission between the drive shaft extension 38 and impeller 50 and assures that vibrations associated with operation of pump 45 will be transmitted through motor casing 35 to support platform 30.

Although described with the respect to a particular embodiment of the invention, it is to be understood that various modifications and/or changes may be made to the specific arrangement described without departing from the spirit of the invention. For instance, although a combined motor-pump-cover assembly has been emphasized in the above description, the invention is not seen to be limited to this combination but also encompasses the particular construction of the pump, cover member or the pump-cover subassembly itself. Also, the particular number and location of the mounting connection points between the cover member 80 and the pump housing 47 and between the pump housing 47 and motor casing 35 may be changed along with the particular of fastening means used therebetween. Therefore, the above description is not intended to limit the scope of the invention as defined by the following claims:

I claim:

1. A pump assembly adapted to be driven by a motor comprising:

a pump including a pump housing and an impeller located within said pump housing, said pump housing including a generally centrally located aperture in one end thereof adjacent said impeller and at least one mounting boss formed integral therewith;

a cover member including a substantially centrally located aperture; and a fluid diverting portion;

means for fixedly securing said cover member directly to said at least one mounting boss of said pump housing with said aperture in said cover member being aligned with said aperture in said pump housing, said pump being adapted to be secured to a housing of a motor used to drive said impeller with said cover member therebetween such that the motor can be protected from any fluid leakage form said pump; and whereby removal of said means for securing said pump housing to said motor casing enables disassembly of said pump and cover member from said motor as a unitary assembly.

2. A pump assembly as claimed in claim 1 wherein said cover member is fixedly secured to said pump housing at two locations circumferentially spaced about said pump housing.

3. A pump assembly as claimed in claim 1 wherein said means for fixedly securing said cover member to said pump housing comprises a threaded fastener extending through said cover member and into said at least one mounting boss.

4. A pump assembly as claimed in claim 3 wherein said cover member includes at least one mounting opening aligned with said at least one mounting boss and said threaded fastener extends through said at least one mounting opening and is threaded within said at least one mounting boss.

5. A pump assembly as claimed in claim 1 wherein said cover member includes a plurality of circumferentially spaced locating openings and said pump housing includes a plurality of locating fingers such that, when said cover member is fixedly secured to said pump housing, each locating finger extends through a respective one of said locating openings.

6. A pump assembly as claimed in claim 5 wherein the fluid diverting portion of said cover member comprises a trough portion defined between an upstanding rim extending around substantially the entire perimeter of said cover member and a raised central portion.

7. A pump assembly as claimed in claim 6 wherein each of said locating openings in said cover member through which said plurality of locating fingers extend is located in an embossed area of said upstanding central portion of said cover member in order to prevent any fluid on said cover member from flowing into these locating openings.

8. A pump assembly as claimed in claim 1 wherein the fluid diverting portion of said cover member comprises a trough portion defined between an upstanding rim extending around substantially the entire perimeter of said cover member and a raised central portion.

9. A pump assembly as claimed in claim in claim 8 further comprising a drain port extending from said trough portion through a section of said rim.

10. A pump assembly as claimed in claim 8 wherein said means for fixedly securing said cover member to said pump housing extends through said cover member in said trough portion.

11. A motor mounted pump assembly comprising:

a pump including a housing and an impeller located within said housing, said housing including a generally centrally located aperture in one end thereof adjacent said impeller;

a cover member including a substantially centrally located aperture and a fluid diverter portion;

means for fixedly securing said cover member directly to said pump housing;

a motor including a casing and a drive shaft rotatably supported within said casing, said drive shaft including an extension protruding out of said casing; and means for securing said pump housing to said motor casing with the extension of said drive shaft extending through said apertures in said cover member and said pump housing and drivingly engaging said impeller such that during operation the motor can be protected from any fluid leakage from said pump, whereby removal of said means for securing said pump housing to said motor casing enables disassembly of said pump and said cover member from said motor as a unitary assembly.

12. A motor mounted pump assembly as claimed in claim 11 wherein the fluid diverting portion said cover member comprises a trough portion defined between an upstanding rim extending around substantially the entire perimeter of said cover member and a raised central portion.

13. A motor mounted pump assembly as claimed in claim 12 wherein said aperture in said cover member through which said drive shaft extends is located in said upstanding central portion and includes an upstanding ridge thereabout to prevent fluid from flowing into said aperture.

14. A motor mounted pump assembly as claimed in claim 11 wherein said motor is arranged with said drive shaft extending substantially vertically upright through said casing; said cover member is mounted to a lower end of said pump housing; and said pump housing is mounted upon said motor casing.

15. A motor mounted pump assembly as claimed in claim 14 wherein said cover member includes a plurality of circumferentially spaced locating openings and said pump housing includes a plurality of locating fingers such that, when said cover member is fixedly secured to said pump housing, each locating finger extends through a respective one of said locating openings.

16. A motor mounted pump assembly as claimed in claim 15 wherein each of said locating fingers includes an inner surface portion facing said drive shaft, each of said inner surface portions being adapted to be located closely adjacent a portion of said motor casing to provide a concentric fit of said pump upon said motor.

17. A motor mounted pump assembly as claimed in claim 16 wherein said motor casing includes an upstanding bearing cover, said drive shaft is rotatably supported by bearings located within said upstanding bearing cover, said locating fingers being located closely adjacent and about the periphery of said bearing cover.

18. A motor mounted pump assembly as claimed in claim 14 wherein said pump housing is formed with at least one mounting leg, said motor casing is formed with at least one mounting post, and said means for securing said pump housing to said motor casing comprises fastening means fixedly securing said at least one mounting leg to said at least one mounting post.

19. A motor mounted pump assembly as claimed in claim 18 wherein said cover member includes at least one opening aligned with said at least one mounting leg of said pump housing and said mounting post of said motor casing such that said means for securing said pump housing to said motor casing freely extends through said cover member.

20. A motor mounted pump assembly as claimed in claim 19 wherein the fluid diverting portion of said cover member includes a trough portion defined between an upstanding rim extending around substantially the entire perimeter of said cover member and a raised central portion, said at least one opening in said cover member is located in said trough portion and includes upstanding edges to prevent any water located in said trough portion from flowing into said at least one opening.

21. A motor mounted pump assembly as claimed in claim 11 wherein said means for fixedly securing said cover member to said pump housing comprises at least one mounting boss formed integral with said pump housing and means for fastening said cover member to said at least one mounting boss.

22. A motor mounted pump assembly as claimed in claim 21 wherein said cover member is fixedly secured to said pump housing at two locations circumferentially spaced about said pump housing.

23. A motor mounted pump assembly as claimed in claim 22 wherein said means for fixedly securing said cover member to said pump housing comprises a threaded fastener extending through said cover member and into said at least one mounting boss.

24. A motor mounted pump assembly as claimed in claim 22 wherein said cover member includes at least one mounting opening aligned with said at least one mounting boss and said threaded fastener extends through said at least one mounting opening and is threaded within said at least one mounting boss.

25. A pump assembly adapted to be attached to both a cover member and a motor comprising:

a pump housing having a generally centrally located aperture;

an impeller located within said pump housing, said impeller including a sleeve portion aligned with said aperture;

first mounting means formed integral with said pump housing, said first mounting means being adapted to receive a threaded fastener for fixedly securing a cover member, having a fluid diverting portion, directly to said pump housing;

second mounting mounting means formed integral with said pump housing, said second mounting means being adapted to receive a fastener for fixedly securing said pump directly to a motor with the cover member positioned between the pump housing and the motor such that the motor will be protected from any fluid leakage from said pump assembly; and whereby removal of said second mounting means enables disassembly of said pump and cover member from said motor as a unitary assembly.

26. A pump assembly as claimed in claim 25 wherein said first mounting means comprises a plurality of mounting bosses which are radially spaced from said aperture and circumferentially spaced about said pump housing.

27. A pump assembly as claimed in claim 26 wherein said second mounting means comprises a plurality of mounting legs which are radially spaced from said aperture and circumferentially spaced about said pump housing.

28. A pump assembly as claimed in claim 25 further comprising a plurality of locating fingers circumferentially spaced about said pump housing and located radially inward from said second mounting means.

29. A pump assembly as claimed in claim 28 further comprising a cover member including a substantially centrally located aperture and means for fixedly securing said cover member to said first mounting means of said pump housing with said aperture in said cover member being aligned with said aperture in said pump housing.

30. A pump assembly as claimed in claim 29 further comprising:

a motor including a casing and a drive shaft rotatably supported within said casing, said drive shaft including an extension protruding out of said casing; and means for securing said pump housing to said motor casing with the extension of said drive shaft extending through said apertures in said cover member and said pump housing and drivingly engaging said impeller, whereby removal of said mans for securing said pump housing to said motor casing permits disassembly of said pump and said cover member from said motor as a unitary assembly.

* * * * *